US010703004B2

(12) United States Patent
Guilbert

(10) Patent No.: US 10,703,004 B2
(45) Date of Patent: Jul. 7, 2020

(54) METHOD FOR MODIFYING THE CUTTING TRAJECTORY FOR PARTS INTENDED TO BE CUT FROM A FLEXIBLE MATERIAL

(71) Applicant: LECTRA, Paris (FR)

(72) Inventor: Sylvain Guilbert, St. Quentin de Baron (FR)

(73) Assignee: LECTRA, Paris (FR)

( * ) Notice: Subject to any disclaimer, the term of this patent is extended or adjusted under 35 U.S.C. 154(b) by 0 days.

(21) Appl. No.: 16/476,417

(22) PCT Filed: Dec. 14, 2017

(86) PCT No.: PCT/FR2017/053569
§ 371 (c)(1),
(2) Date: Jul. 8, 2019

(87) PCT Pub. No.: WO2018/127637
PCT Pub. Date: Jul. 12, 2018

(65) Prior Publication Data

US 2020/0001488 A1 Jan. 2, 2020

(30) Foreign Application Priority Data

Jan. 9, 2017 (FR) ..... 17 50173

(51) Int. Cl.
*B26D 5/00* (2006.01)
*B26F 1/38* (2006.01)
(Continued)

(52) U.S. Cl.
CPC ..... *B26D 5/005* (2013.01); *B26F 1/3813* (2013.01); *B26D 7/018* (2013.01); *B26D 7/1818* (2013.01);
(Continued)

(58) Field of Classification Search
CPC ..... Y10T 83/04; Y10T 83/148; Y10T 83/152; Y10T 83/155; B26D 5/005; B26D 5/00;
(Continued)

(56) References Cited

U.S. PATENT DOCUMENTS 3,766,813 A * 10/1973 Pearl ..... B26D 5/00 83/56
4,178,820 A 12/1979 Gerber
(Continued)

FOREIGN PATENT DOCUMENTS

GB 2138595 A 10/1984
WO 2007085584 A1 8/2007

OTHER PUBLICATIONS

French Search Report from FR Application No. 1750173, dated Sep. 21, 2017.
(Continued)

*Primary Examiner* — Phong H Nguyen
(74) *Attorney, Agent, or Firm* — Workman Nydegger

(57) ABSTRACT

A method is provided for automatically modifying the cutting paths for parts to be cut out from a flexible material by automatically moving a cutter tool along predetermined cutting paths. The cutting paths are associated with each part being defined by a succession of cutting segments forming a polygon. Two cutting segments are identified and belonging to two different parts for cutting out in the material and for which a maximum distance condition between these cutting segments is satisfied. Two cutting segments are verified for being situated facing each other, and that no other cutting segments lie between the two cutting segments. A common cutting path for the two cutting segments is computed, and a common cutting path is connected to the cutting paths of the two parts for cutting out to obtain modified cutting paths for the two parts for cutting out.

11 Claims, 4 Drawing Sheets

(51) Int. Cl.
*B26D 7/01* (2006.01)
*B26D 7/18* (2006.01)

(52) U.S. Cl.
CPC ..... *B26D 7/1854* (2013.01); *B26D 2005/002* (2013.01); *B26F 2001/388* (2013.01); *Y10T 83/155* (2015.04)

(58) Field of Classification Search
CPC .... B26D 7/018; B26D 7/1818; B26D 7/1854; B26D 2005/002; B26F 1/3813; B26F 1/3806; B26F 2001/388
See application file for complete search history.

(56) References Cited

U.S. PATENT DOCUMENTS 4,327,615 A * 5/1982 Gerber ..... B26D 5/00 83/49
4,583,181 A * 4/1986 Gerber ..... A41H 43/00 700/143
6,810,779 B2 * 11/2004 Feldman ..... B26D 5/00 700/134
9,008,824 B1 * 4/2015 Blaine ..... B26D 5/00 700/186

OTHER PUBLICATIONS

International Search Report from PCT Application No. PCT/FR2017/053569, dated Jan. 26, 2018.

* cited by examiner

METHOD FOR MODIFYING THE CUTTING TRAJECTORY FOR PARTS INTENDED TO BE CUT FROM A FLEXIBLE MATERIAL

BACKGROUND OF THE INVENTION

The present invention relates to the general field of cutting parts out from a flexible material.

A particular but non-limiting field of application for the invention is that of cutting parts out from a piece of non-textile flexible material such as leather, in particular in the clothing, furnishing, or automotive upholstery industries.

In known manner, the process of cutting parts out from a piece of flexible material, e.g. such as a skin, takes place as follows. The skin for cutting up is initially prepared, i.e. an operator looks for any defects in the skin and identifies them directly on the skin by means of marks. The skin with its marks is then digitally scanned. Using the digital representation of the skin and appropriate software means, the operator obtains an optimized layout of the various parts that are to be cut out from the skin. The layout is converted into a program for cutting out parts. The skin is then placed on a cutting table where it is cut up, generally by means of a blade forming part of a cutter tool and moving through the skin along cutting paths that are defined by the pre-established program for cutting out the parts.

Nevertheless, cutting out parts with such a process can raise certain problems, in particular when two parts for cutting out in the skin are too close to each other (typically less than 1 millimeter (mm) apart from each other). Specifically, in this situation, after the first part has been cut out, the blade of the cutter tool that is cutting out the second part runs the risk of being "attracted" by the cutout left by the first part because of its proximity. As a result, the second part can present cutting out defects that degrade the quality of the resulting part.

OBJECT AND SUMMARY OF THE INVENTION

A main object of the present invention is to mitigate such drawbacks by proposing to transform the cutting paths of two neighboring parts that are to be cut out.

In accordance with the invention, this object is achieved by a method of automatically modifying the cutting paths for parts that are to be cut out from a flexible material by automatically moving a cutter tool along predetermined cutting paths, the cutting paths associated with each part being defined by a succession of cutting segments forming a polygon, the method comprising in succession:

a step of identifying two cutting segments belonging to two different parts for cutting out in the material and for which a maximum distance condition between these cutting segments is satisfied;

a step of verifying that the two previously-identified cutting segments are situated facing each other by reciprocal orthogonal projection of the cutting segments onto each other;

a step of verifying that no other cutting segments lie between the two previously-identified cutting segments by computing intersections between the two parts for cutting out;

a step of computing a common cutting path for the two previously-identified cutting segments; and a step of connecting the common cutting path to the cutting paths of the two parts for cutting out so as to obtain modified cutting paths for the two parts for cutting out.

The invention is remarkable in that it proposes a method enabling the cutting paths of two parts that are too close together to be modified automatically by creating two cutting paths that are exactly superposed for the two cutting segments where they are close to each other. In other words, the method of the invention serves to modify the cutting paths of the two parts a little in order to superpose them for cutting segments that are in the proximity of each other. As a result, any defect in the cutting out of these parts resulting from their close proximity can be avoided.

Furthermore, the method of the invention is in the form of an algorithm that is simple and fast to implement automatically. In particular, this algorithm for modifying the cutting path can be incorporated in the step of preparing the program for cutting out all of the parts in the layout for cutting out from a skin so as to enable the operator to retain control over the final result.

The step of identifying two cutting segments may comprise in succession and for each part for cutting out: expanding the polygon formed by the cutting segments of said part by a predetermined value in order to obtain a first expanded polygon; identifying an intersection between the first expanded polygon and a polygon formed by the cutting segments of another part; expanding the polygon formed by the cutting segments of the other part by the predetermined value in order to obtain a second expanded polygon; identifying an intersection between the second expanded polygon and the polygon formed by the cutting segments of said part; and uniting intersections in order to obtain cutting segments belonging to two different parts for cutting out and for which a maximum distance condition between these cutting segments is satisfied.

Furthermore, the step of verifying that the previously-identified cutting segments may be situated facing each other comprises: reciprocally orthogonally projecting the cutting segments onto each other; projecting each cutting segment onto the other cutting segment in a direction orthogonal to the projected cutting segment; and uniting the projections as performed in this way in order to obtain two cutting segment portions situated facing each other.

Likewise, the step of verifying that no other cutting segments lie between the two cutting segments may comprise, in succession: computing intersections between the two parts; constructing a geometrical quadrilateral formed by the two cutting segments; intersecting between the previously-constructed quadrilateral and the two parts for cutting out; and subtracting the overlaps between the two parts for cutting out from the previously-constructed quadrilateral.

Under such circumstances, when the subtraction of overlaps gives an empty set, the method may further comprise indicating that no cutting path is present between the two cutting segments.

The step of computing a common cutting path for the two cutting segments may comprise: projecting each cutting segment onto the other cutting segment while conserving the same length ratio for each segment; and creating a common cutting path by connecting together points situated at equal distances from the ends of the projections of the cutting segments.

Advantageously, the step of connecting the common cutting path to the cutting paths of two parts for cutting out comprises applying the following connections taken in succession until a functional connection is obtained: connection by extending the common cutting path, straight-line connection of the common cutting path, connection with shortening of the common cutting path, straight-line connection with shortening of the common cutting path, connection by extending the common cutting path with another common cutting path, straight-line connection of the common cutting path with another common cutting path.

The term "functional connection" is used herein to mean a connection for which the algorithm defined for making the connection in question enables a non-zero result to be obtained.

Under such circumstances, the method preferably further comprises verifying that the connections that are applied do not lead to the cutting paths of two parts for cutting out being deflected by more than a predetermined angle.

The invention also provides the use of the method as defined above to modify automatically the cutting path for parts that are to be cut from a leather skin.

The invention also provides a computer program including instructions for executing steps of the above-defined method for automatically modifying the cutting paths for parts.

The invention also provides a computer readable data medium including instructions of a computer program as mentioned above. The data medium may be any entity or device capable of storing the program. For example, the medium may comprise storage means, such as a read-only memory (ROM), e.g. a compact disk (CD) ROM or a microelectronic circuit ROM, or indeed magnetic recording means, e.g. a floppy disk or a hard disk.

Furthermore, the data medium may be a transmissible medium such as an electrical or optical signal, suitable for being conveyed via an electrical or optical cable, by radio, or by other means. The program of the invention may in particular be downloaded from an Internet type network. Alternatively, the data medium may be an integrated circuit in which the program is incorporated, the circuit being adapted to execute or to be used in the execution of the method in question.

BRIEF DESCRIPTION OF THE DRAWINGS

Other characteristics and advantages of the present invention appear from the following description made with reference to the accompanying drawings, which show an implementation having no limiting character. In the figures.

DETAILED DESCRIPTION OF THE INVENTION

In the following description, parts are to be cut out from skins in order to make leather articles. Nevertheless, the invention is applicable to cutting parts out from a flexible material other than leather.

Figure 1:
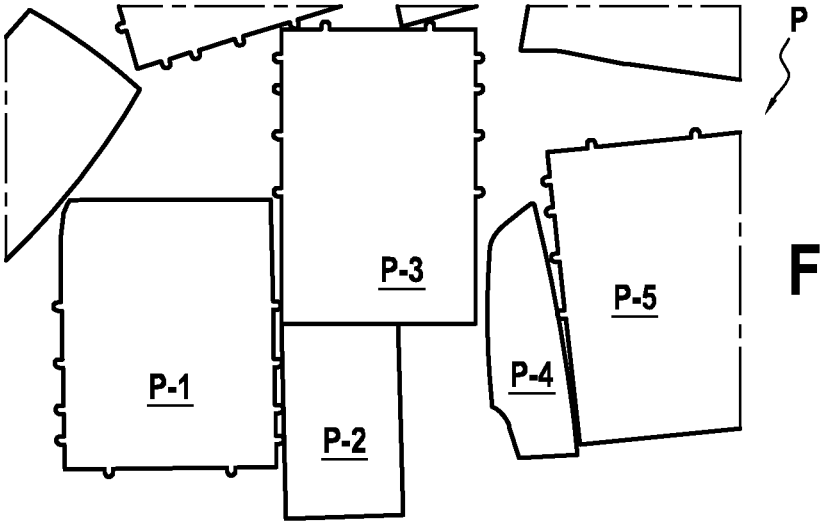
FIG. 1 is a diagrammatic view showing an example layout of parts for cutting out from flexible material to which the method of the invention is applied.

FIG. 1 shows an example layout P of a plurality of parts p-1, p-2, p-3, . . . , etc. that are to be cut out from a skin. Typically, the layout P is a digital file comprising a digital representation of the skin together with its defects, if any, and a digital representation of the outline of each part that is to be cut out from the skin. The parts (i.e. their digital representations) are positioned on the skin (i.e. its digital representation) using an optimized layout that takes account in particular of any defects in the skin and that seeks to minimize losses of material.

This layout P is obtained by digital software forming part of a computer workstation, either automatically, or else by interaction with an operator. Thereafter, the layout P is converted into a program for cutting out the parts, i.e. into instructions for moving a cutter head along predetermined cutting paths through the skin while in position on a cutting table.

The cutting paths associated with each part for cutting out are defined as a succession of straight-line cutting segments that are connected to one another to form a polygon surrounding the geometrical outline of the part.

Figure 2:
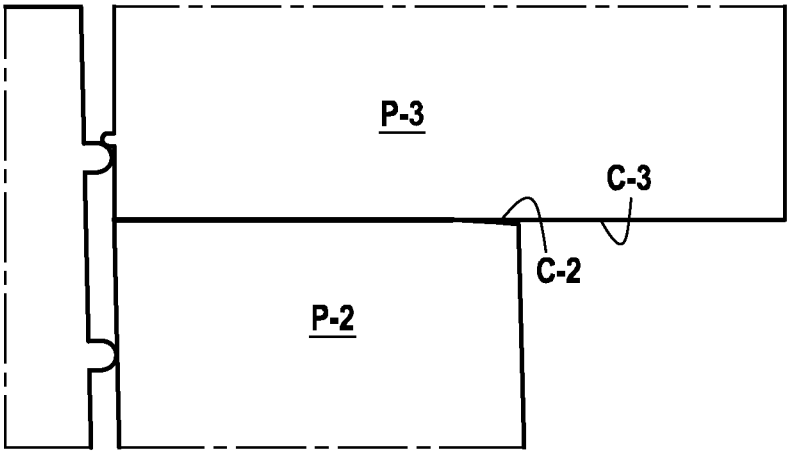
FIG. 2 is a detail of FIG. 1 showing two parts of the layout where cutting segments are very close to each other.

The optimized layout P may give rise to two parts being positioned very close to each other: this applies in particular for the parts p-2 and p-3 shown in FIG. 1. Specifically, and as shown in greater detail in FIG. 2, each of these parts p-2 and p-3 presents a respective side c-2, c-3 for which the cutting paths are very close together. By way of example, cutting paths are said to be very close together when they are spaced apart from each other by less than 1 mm.

In this situation, after the first part has been cut out (e.g. the part p-2), the blade of the cutter tool cutting out the second part (e.g. the part p-3) runs the risk of being "attracted" by the cutout left by the first part because of its proximity. This results in the second part presenting cutting defects that degrade the quality of the cutout parts.

In order to avoid this problem, the method of the invention makes provision for automatically modifying the cutting paths of the two parts p-2 and p-3 by modifying the cutting segments that correspond to the respective sides c-2 and c-3 of these parts so as to create two cutting paths that are accurately superposed for these two cutting segments. Thus, the cutter tool passes twice between the two parts p-2 and p-3, but along exactly the same path.

The first step of the method of the invention consists in automatically identifying all of the pairs of cutting segments in the layout P that belong to two different parts for cutting out from the material and for which a maximum distance condition between those cutting segments is satisfied.

This first step is performed by expanding each part of the layout by the maximum distance and intersecting it with the other parts of the layout in order to determine which parts satisfy the maximum distance condition.

Figure 3:
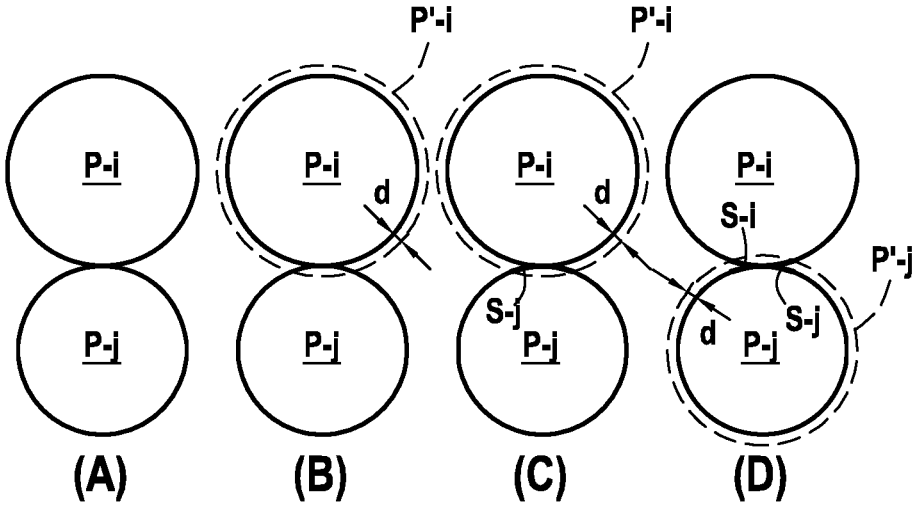
FIG. 3 is a diagrammatic view showing an example of implementing the step of identifying two cutting segments for which a maximum distance condition is satisfied.

FIG. 3 shows an example of performing this first step for two parts p-i and p-j of the layout (diagram (A)). For reasons of clarity, these parts are shown in this example as having circular outlines. Naturally, the expansion principle as described below can be adapted to parts of polygonal outline.

In a first substep, one of the two parts (the part p-i in the example of diagram (B)) is expanded by a determined value d corresponding to the maximum distance (e.g. 1 mm). In practice, this expansion corresponds to expanding the polygon formed by the cutting segments of the part p-i and it serves to obtain a first expanded part p'-i.

In a second substep (diagram (C) of FIG. 3), the geometrical intersection is identified between the first expanded part p'-i and the second part p-j (or more precisely the cutting segments associated with the second part). In this example, the intersection is represented by circular arc s-j.

In a third substep, the second part (the part p-j in the example of diagram D)) is in turn expanded by the predetermined value d so as to obtain a second expanded part p'-j.

The geometrical intersection between the second expanded part p'-j and the first part p-i is then identified. In the example of FIG. 3, this intersection gives a circular arc s-i.

Finally, the last substep makes provision for uniting the two intersections s-i and s-j as identified in this way in order to obtain two cutting segments belonging to two different parts p-i and p-j for cutting out and for which the maximum distance condition d between these cutting segments is satisfied.

This first step of the method consisting in identifying two cutting segments for which a maximum distance condition between the cutting segments is satisfied is performed for all of the parts p of the layout P.

The second step of the method of the invention consists in verifying automatically that the two previously-identified cutting segments are indeed situated facing each other.

Figure 4A:
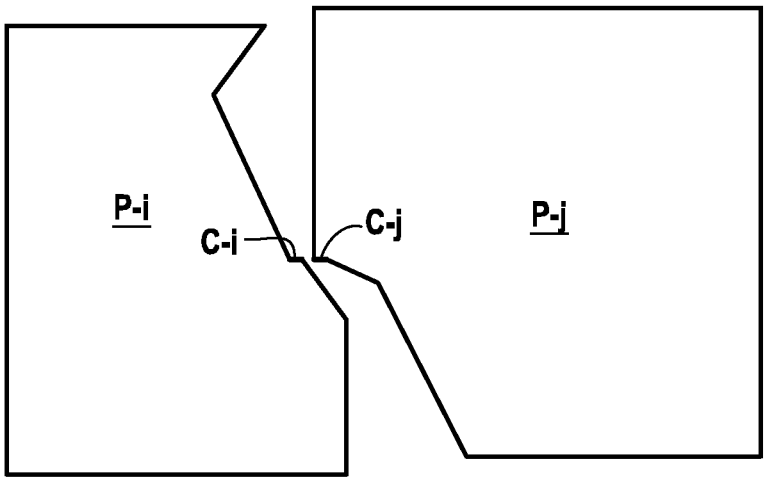
FIGS. 4A and 4B show examples of parts having cutting segments that satisfy the above-mentioned maximum distance conditions.

Specifically, and as shown in FIG. 4A, it can happen that the algorithm used during the first step of the method identifies two parts p-i and p-j in the layout for which two respective cutting segments c-i and c-j are spaced apart from each other by a distance less than the predetermined maximum distance. As can clearly be seen in FIG. 4A, these two cutting segments c-i and c-j are not situated facing each other, so it is not possible to establish a common cutting path for these cutting segments.

Figure 4B:
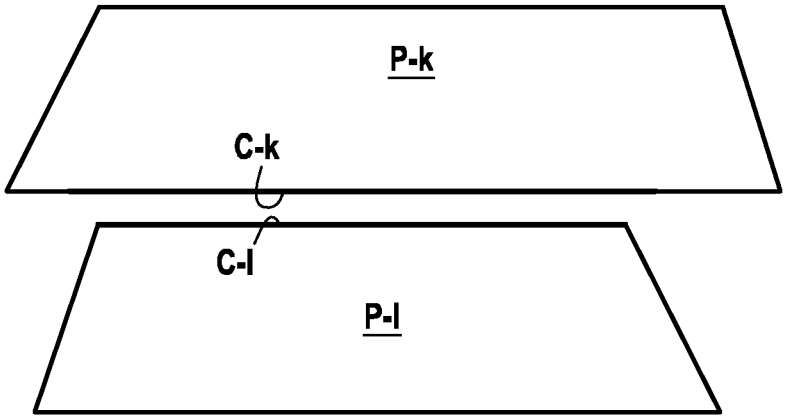

Likewise, and as shown in FIG. 4B, it is also possible that the algorithm used in the first step of the method identifies two parts p-k and p-l for which two respective cutting segments c-k and c-l are spaced apart from each other by a distance less than the maximum predetermined distance even though one of the cutting segments (specifically the segment c-k) is longer than the other. In this situation, the step of establishing a common cutting path for the two cutting segments risks leading to a problem.

In order to avoid these setbacks, the second step of the method of the invention makes provision for adding a constraint to the previously-identified cutting segment pairs in order to ensure that it is possible to establish a common cutting path.

For this purpose, for each identified pair of cutting segments, this second step comprises a first substep consisting in projecting each cutting segment onto the other cutting segment (or rather onto the straight line including this other cutting segment) in a direction orthogonal to the target cutting segment.

Figure 5A:
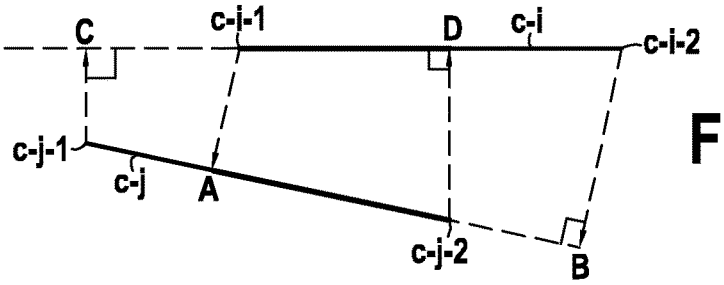
FIGS. 5A to 5C are diagrams showing an example of performing the step of verifying that the two previously-identified cutting segments are situated facing each other.

An example is shown in FIG. 5A with two cutting segments c-i and c-j for which it has previously been verified that the maximum distance condition is satisfied.

The two ends c-i-1 and c-i-2 of the cutting segment c-i are projected orthogonally onto the straight line on which the cutting segment c-j lies. These projections cross the line on which the cutting segment c-j lies at a point A for the end c-i-1 and at a point B for the other end c-i-2, it being possible for these points of intersection to lie on the cutting segment c-j (as for the point A) or off this cutting segment (as for the point B).

Likewise, the two ends c-j-1 and c-j-2 of the cutting segment c-j are projected orthogonally onto the straight line on which the cutting segment c-i lies. These projections cross the straight line on which the cutting segment c-i lies at a point C (in this example off the cutting segment c-i) for the end c-j-1, and at a point D (in this example on the cutting segment c-i) for the other end c-j-2.

A second substep consists in projecting each cutting segment onto the other cutting segment (or rather onto the straight line on which the other cutting segment lies) in a direction orthogonal to the projected cutting segment.

Figure 5B:
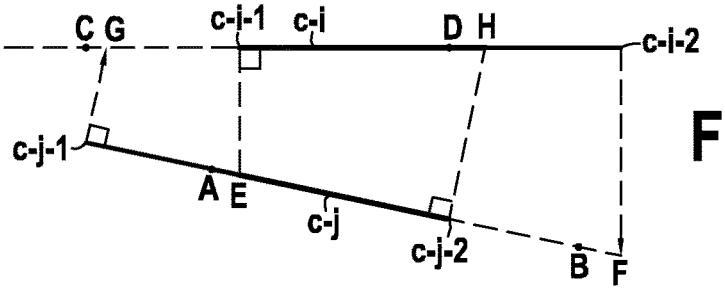

Thus, in the example shown in FIG. 5B, the two ends c-i-1 and c-i-2 of the cutting segment c-i are projected onto the line on which the cutting segment c-j lies in a direction that is orthogonal to the cutting segment c-i. These projections cross the straight line on which the cutting segment c-j lies at a point E (or the end c-i-1) and at a point F (for the end c-i-2).

Likewise, the two ends c-j-1 and c-j-2 of the cutting segment c-j are projected onto the line on which the cutting segment c-i lies in a direction that is orthogonal to the cutting segment c-j. These projections cross the line on which the cutting segment c-i lies at a point G (for the end c-j-1) and at a point H (for the end c-j-2).

The last substep then consists in uniting the projections as performed in this way and in eliminating those portions that lie outside the cutting segments so as to obtain two cutting segment portions that face each other.

Figure 5C:
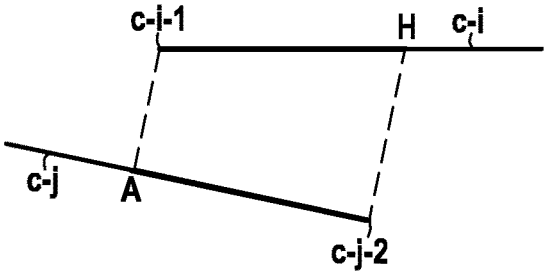

In the example shown in FIG. 5C, uniting in this way gives two cutting segment portions that are defined, for the cutting segment c-i, by the points c-i-1 and H, and for the cutting segment c-j, by the points A and c-j-2. It is considered that these two cutting segment portions are situated facing each other.

The third step of the method of the invention consists in verifying that there are no other cutting segments between the two previously-identified cutting segments. This step serves to ensure that the cutting segments that have been identified are indeed situated on the proper sides of the parts (i.e. that no other portions of the parts lie between the two cutting segments).

This third step is performed by computing intersections between the two parts for cutting out. Specifically, it is verified whether the zone between the two identified cutting segments intersects a part, and if it does, it is verified whether this is an overlap zone between the parts in order to determine whether the pair of cutting segments is valid. Naturally, when the zone between the two cutting segments does not intersect any other part or when the parts overlap at this location, the pair of cutting segments is valid and the method moves on to the following step.

An implementation of this third step for two parts p-i and p-j is described below with reference to FIGS. 6A to 6D.

In this example, it is considered that the two parts p-i and p-j for cutting out overlap in their respective cutting segments c-i and c-j (this overlap being of very small dimensions, less than 0.1 mm).

Figure 6A:
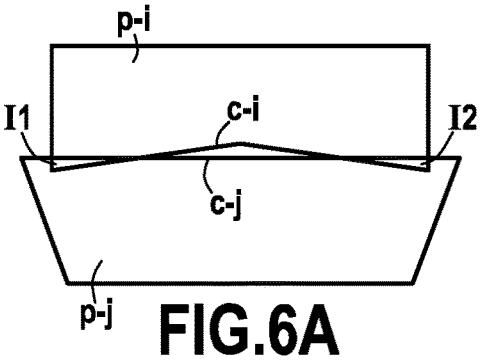
FIGS. 6A to 6D are diagrams showing an example of performing the step of verifying that there are no other cutting segments between two cutting segments.
Figure 6B:
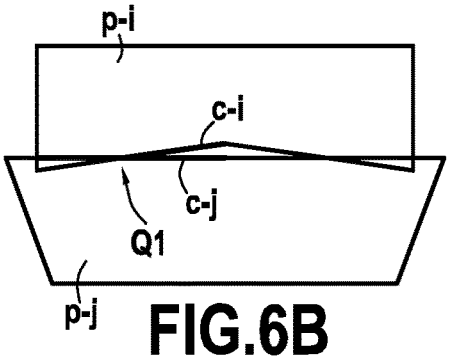
Figure 6C:
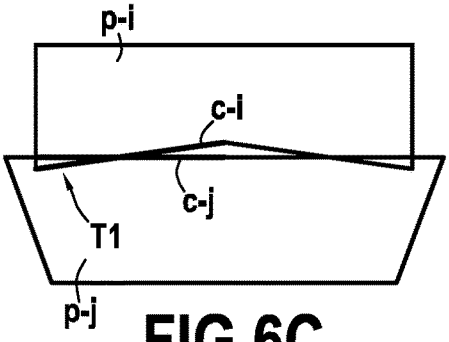

The first substep consists in computing intersections I1 and I2 between the two parts (two intersections in this example—cf. FIG. 6A). In a second substep, a quadrilateral Q1 is constructed made up by the pair of cutting segments c-i and c-j (cf. FIG. 6B). In a third substep, the quadrilateral Q1 is intersected with the two parts p-i and p-j (this intersection resulting in a polygon T1—cf. FIG. 6C).

Figure 6D:
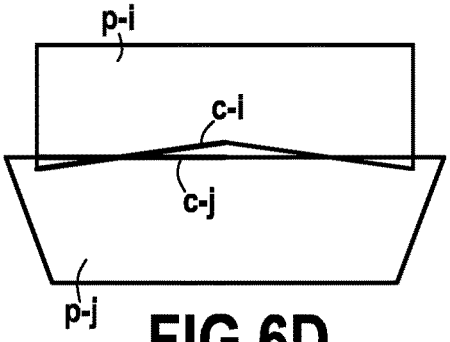

Finally, in a fourth and last substep, subtraction is performed between the polygon T1 and the intersections I1 and I2 (FIG. 6D). If the result of this subtraction gives an empty set (as in the example of FIG. 6D), it is deduced that no cutting path is present between the two cutting segments c-i and c-j, and this pair of cutting segments is declared valid with respect to this criterion.

Once the cutting segments have been identified and validated, the method of the invention makes provision for concatenating the cutting segments that are mutually adjacent in order to form cutting paths (made up of pluralities of adjacent cutting segments), and then during a fourth step, for computing common cutting paths for all of the cutting segments.

Figure 7A:
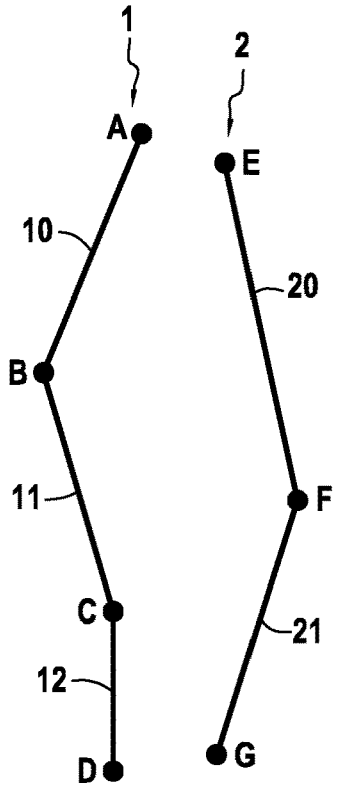
FIGS. 7A to 7C are diagrams showing an example of performing the step of computing a common cutting path for two cutting segments.

An example of performing this step is described in detail below with reference to FIGS. 7A to 7C. These figures show two cutting paths 1 and 2 (each formed by a concatenated plurality of adjacent cutting segments) that have been identified and validated during the above-described steps of the method. Naturally, the same method is used when the cutting path comprises only one cutting segment.

More precisely, in this example, the cutting path 1 is made up of three interconnected cutting segments, namely the segments 10 to 12, while the cutting path 2 is made up of two cutting segments 20 and 21. The cutting segments 10 to 12 are defined by points A, B, C, and D. Likewise, the cutting segments 20 and 21 are defined by points E, F, and G.

Figure 7B:
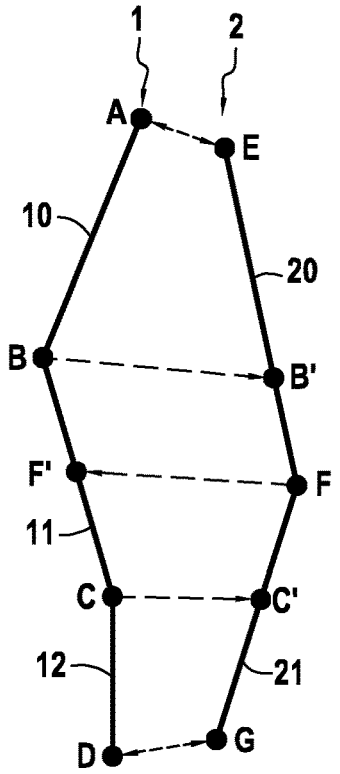
Figure 7C:
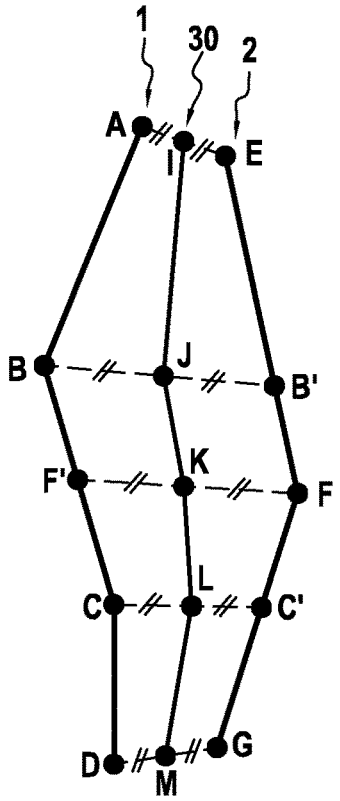

Each cutting path 1, 2 is projected onto the other cutting path while conserving the same length ratio for each of the cutting segments 10-12, 20, 21 (see FIG. 7B).

Thus, the cutting segment 10 is projected onto the cutting path 2 with the point A being projected onto E and the point B onto B' (with the length of the segment [AB] divided by the length of the path 1, which is equal to the length of the segment [EB'] divided by the length of the path 2). Likewise, the segment 12 is projected onto the cutting path 2 with the point D being projected onto G and the point C onto C' (with the length of the segment [CD] divided by the length of the path 1, which is equal to the length of the segment [C'G] divided by the length of the path 2).

Furthermore, the cutting segment 20 of the cutting path 2 is projected onto the cutting path 1 with the point E being projected onto A and the point F onto F' (the length of the segment [EF] divided by the length of the path 2 is equal to the length of the segment [AF'] divided by the length of the path 1). Finally, the cutting segment 21 is also projected onto the cutting path 1 with the point F being projected onto F' and the point G onto D (the length of the segment [FG] divided by the length of the path 2 is equal to the length of the segment [F'D] divided by the length of the path 1).

From the segments [AE], [BB'], [FF'], [CC'], and [DG] as created in this way, this step makes provision for creating a common cutting path 30 from points situated at equal distances from the ends of these segments (i.e. the point I for the segment [AE], the point J for the segment [BB'], the point K for the segment [FF'], the point L for the segment [CC'], and the point M for the segment [DG]).

The last step of the method of the invention consists in connecting the common cutting path to the cutting paths of the two parts for cutting out so as to obtain modified cutting paths for the two parts for cutting out.

This connection step is performed in order to attempt to conserve as much as possible of the shape of the outlines of the parts for cutting out. Depending on the situation that is encountered, various types of connection are possible, including connection by extension for which an example implementation is shown in FIG. 8, and straight-line connection for which an example implementation is shown in FIG. 9.

Figure 8:
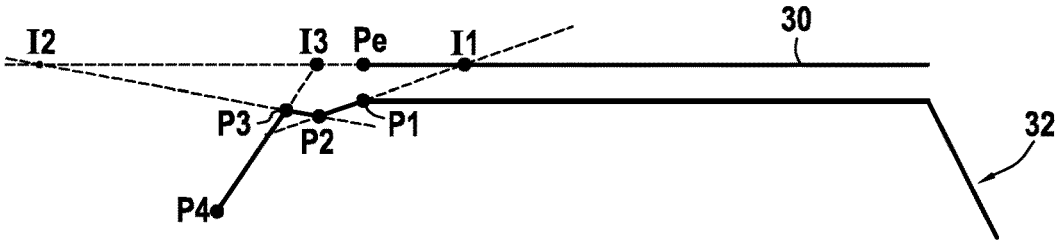
FIG. 8 shows an example of connecting a common cutting part by extending it.
Figure 9:
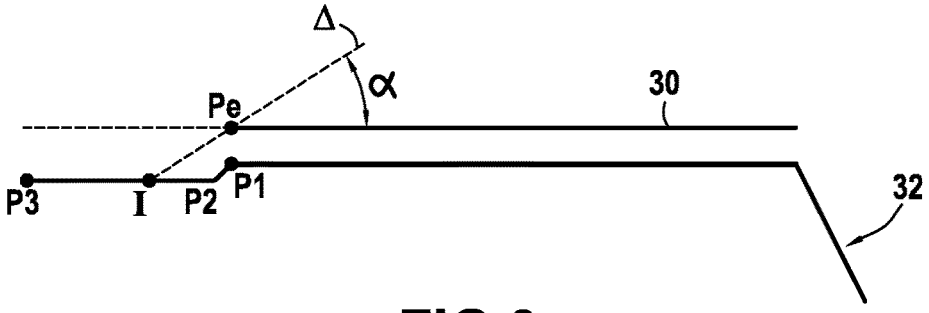
FIG. 9 shows an example of making a straight-line connection of a common cutting path.

In the example of connection by extension shown in FIG. 8, the common cutting path 30 is shown with its end point Pe together with the outline 32 of the part to which the cutting path is connected.

The outline 32 of the part to which the cutting path is connected is made up of a plurality of cutting segments. If the point P1 is considered as being the end point of the outline 32 used for computing the common cutting path 30, the outline 32 in this example is made up of the cutting segments [P1P2], [P2P3], [P3P4], etc.

The algorithm performed in this step of connection by extension provides for running along each cutting segment of the outline 32 starting from point P1 until reaching the point for which the accumulated curvilinear distance does not exceed twice the maximum distance d defined in the first step of the method of the invention. The term "accumulated curvilinear distance" is used to mean the distance along the curve between the point P1 and the cutting segment under consideration, i.e. the sum of the lengths of the cutting segments [P1P2], [P2P3], etc. until reaching the cutting segment under consideration.

For each of these segments [P1P2], [P2P3], [P3P4], etc., the step of connection by extension performs the following substeps in succession.

During a first sub step, it is verified whether the segment and the common cutting path are parallel. If the segment is parallel with the common cutting path, the method moves on to the following segment.

During a second substep, consideration is given to the point of intersection between the segment under consideration and the common cutting path (or their respective extensions). If this point of intersection is beyond the end of the segment furthest from the common cutting path, then the method moves on to the following segment.

In the example of FIG. 8, the respective intersections between the segments [P1P2], [P2P3], [P3P4] and the common cutting path 30 are respectively referenced I1, I2, and I3. In this example, only the points I1 and I3 satisfy the above condition (which is not satisfied by the point I2).

For the first segment retained at the end of the preceding substep, the third sub step provides for comparing the distance between the previously-determined point of intersection and the end point Pe of the common cutting path with a predetermined threshold corresponding to the maximum distance d defined in the first step of the method of the invention.

If this distance between the point of intersection and the end point Pe is greater than the maximum distance d, then the method moves on to the following segment. In contrast, as soon as a segment is obtained for which the distance between the point of intersection and the end point Pe is less than or equal to the maximum distance d, then this point of intersection is retained as the connection point between the common cutting path and the outline of the part.

Furthermore, if after running along all of the segments of the outline without finding any point of intersection satisfying the above condition, then connection by extension cannot be applied.

In the example shown in FIG. 8, the point of intersection I1 between the segment [P1P2] and the common cutting path is situated at a distance from the end Pe of the common cutting path 30 that is greater than the maximum distance d. However, in this example the distance between the point Pe and the point of intersection I3 between the segment [P2P3]

and the common cutting path is less than the distance d, such that the point I3 is retained and defined as being the connection point between the common cutting path and the outline of the part.

With reference to FIG. 9, there follows a description of an example of another type of connection, specifically a straight-line connection of the common cutting path.

This figure shows the common cutting path 30 together with its end point Pe, and it also shows the outline 32 of the part to which the cutting path is connected, which outline is constituted by the segments [P1P2], [P2P3], etc. (P1 being the end point of the outline used for computing the common cutting path 30).

In the same manner as for connection by extension, the algorithm performed in this step of straight-line connection makes provision for running along each cutting segment of the outline from the point P1 until reaching the point for which the accumulated curvilinear distance does not exceed twice the maximum distance d defined in the first step of the method.

Furthermore, this algorithm proposes verifying that the connections that are applied do not lead to the cutting paths for the two parts for cutting out being deflected by more than a predetermined angle $\alpha$ (typically 20°).

For each of these segments [P1P2], [P2P3], etc., the step of straight-line connection performs the following substeps in succession.

During a first substep, the set of points I of the segment under consideration that make it possible to have an angle of deflection between the common cutting paths and the segment [PeI] that is less than the angle $\alpha$ is computed. For this purpose, two straight lines $\Delta$ are computed that pass through the point Pe and that form respective angles $+\alpha$ and $-\alpha$ with the common cutting path 30 (only one straight line $\Delta$ satisfying this condition is shown in FIG. 9). The points that satisfy the above condition are those points of the segment under consideration that lie between the two straight lines $\Delta$.

During a second substep, the set of points I of the segment under consideration that make it possible to have an angle of deflection between the segment [PeI] and the segment under consideration that is less than the angle $\alpha$ are computed. For this purpose, the sole point is computed for which this angle is equal to $\alpha$ in absolute value. The points satisfying the above condition are the points of the segment under consideration that lie beyond this point in the direction of the outline.

Finally, during a third substep, the two sets obtained in the preceding substeps are intersected in order to find the set of points that satisfy both conditions simultaneously. Any point belonging to this step may constitute the connection point between the common cutting path and the outline of the part, and it is the first point in the direction of the outline that is selected.

If after running along the segments of the outline no point of intersection is found that satisfies the above-mentioned condition, then straight-line connections cannot be applied.

It is possible to envisage connections of types other than those described in detail. For example, a straight-line connection could be applied while shortening the common cutting path. This type of connection applies more particularly when a common cutting path terminates at a very acute angle of the outline of a part. Under such circumstances, neither of the above-described types of connection can be used. The algorithm for connection with shortening is the same as that for straight-line connection, but instead of starting from the end of the common cutting path (point Pe), the fixed point used is the end of the acute angle formed by the outline of the part and each cutting segment of the outline is run along in the manner described above.

When two common cutting paths are to be connected together and when they terminate close to an angle of a part, those two common cutting paths may be extended to their point of intersection (connection by extending the common cutting path with another common cutting path).

When two common cutting paths are parallel (or almost parallel), the above type of connection does not apply and instead it is possible to apply a straight-line connection of the common cutting path with another common cutting path. With this type of connection, it is the end of one of the common cutting paths that is taken as the fixed point and the method runs along the segments of the other common cutting path (the fixed point is selected on the common cutting path as being the point closest to the parts in order to avoid cutting off the corner of a part).

When a plurality of types of connection are all possible, it is important to specify an order of priority for such connections. For the above-described type of connection, the priority order used is as follows: firstly, connection by extension of the common cutting path is applied, and then if necessary straight-line connection of the common cutting path, and then if necessary connection with shortening of the common cutting path, and then if necessary straight-line connection with shortening of the common cutting path, and then if necessary connection by extending the common cutting path with another common cutting path, and finally, if necessary, straight-line connection of the common cutting path with another common cutting path.

The invention claimed is:

1. A method of automatically modifying the cutting paths for parts that are to be cut out from a flexible material by automatically moving a cutter tool along predetermined cutting paths, the cutting paths associated with each part being defined by a succession of cutting segments forming a polygon, the method comprising in succession:

a step of identifying two cutting segments belonging to two different parts for cutting out in the material and for which a maximum distance condition between these cutting segments is satisfied;

a step of verifying that the two previously-identified cutting segments are situated facing each other by reciprocal orthogonal projection of the cutting segments onto each other;

a step of verifying that no other cutting segments lie between the two previously-identified cutting segments by computing intersections between the two parts for cutting out;

a step of computing a common cutting path for the two previously-identified cutting segments; and a step of connecting the common cutting path to the cutting paths of the two parts for cutting out so as to obtain modified cutting paths for the two parts for cutting out.

2. The method according to claim 1, wherein the step of identifying two cutting segments comprises, in succession and for each part for cutting out:

expanding the polygon formed by the cutting segments of said part by a predetermined value in order to obtain a first expanded polygon;

identifying an intersection between the first expanded polygon and a polygon formed by the cutting segments of another part;

expanding the polygon formed by the cutting segments of the other part by the predetermined value in order to obtain a second expanded polygon;

identifying an intersection between the second expanded polygon and the polygon formed by the cutting segments of said part; and uniting intersections in order to obtain cutting segments belonging to two different parts for cutting out and for which a maximum distance condition between these cutting segments is satisfied.

3. The method according to claim 1, wherein the step of verifying that the previously-identified cutting segments are situated facing each other comprises:

reciprocally orthogonally projecting the cutting segments onto each other;

projecting each cutting segment onto the other cutting segment in a direction orthogonal to the projected cutting segment; and uniting the projections as performed in this way in order to obtain two cutting segment portions situated facing each other.

4. The method according to claim 1, wherein the step of verifying that no other cutting segments lie between the two cutting segments comprises, in succession:

computing intersections between the two parts;

constructing a geometrical quadrilateral formed by the two cutting segments;

intersecting between the previously-constructed quadrilateral and the two parts for cutting out; and subtracting the overlaps between the two parts for cutting out from the previously-constructed quadrilateral.

5. The method according to claim 4, further comprising, when the subtraction of overlaps gives an empty set, indicating that no cutting path is present between the two cutting segments.

6. The method according to claim 1, wherein the step of computing a common cutting path for the two cutting segments comprises:

projecting each cutting segment onto the other cutting segment while conserving the same length ratio for each segment; and creating a common cutting path by connecting together points situated at equal distances from the ends of the projections of the cutting segments.

7. The method according to claim 1, wherein the step of connecting the common cutting path to the cutting paths of two parts for cutting out comprises applying the following connections taken in succession until a functional connection is obtained:

connection by extending the common cutting path, straight-line connection of the common cutting path, connection with shortening of the common cutting path, straight-line connection with shortening of the common cutting path, connection by extending the common cutting path with another common cutting path, straight-line connection of the common cutting path with another common cutting path.

8. The method according to claim 7, further comprising verifying that the connections that are applied do not lead to the cutting paths of two parts for cutting out being deflected by more than a predetermined angle.

9. The method according to claim 1, wherein the cutting path for parts are on a leather skin.

10. A computer program including instructions for executing steps of the method according to claim 1 for modifying the cutting paths of parts.

11. A computer readable data medium storing a computer program including instructions for executing steps of the method according to claim 1 for modifying the cutting paths of parts.

* * * * *